United States Patent [19]

Williamson

[11] Patent Number: 4,873,829

[45] Date of Patent: Oct. 17, 1989

[54] STEAM POWER PLANT

[76] Inventor: Anthony R. Williamson, 4267 Bethel Blvd., Houston, Tex. 77092

[21] Appl. No.: 237,086

[22] Filed: Aug. 29, 1988

[51] Int. Cl.[4] ..... F01K 13/00

[52] U.S. Cl. ..... 60/670; 60/646; 60/657

[58] Field of Search ..... 60/643, 645, 654, 670, 60/685, 689, 691, 692, 646, 657

[56] References Cited

U.S. PATENT DOCUMENTS

| | | | |
|---|---|---|---|
| 3,861,151 | 1/1975 | Hosokawa | 60/689 |
| 4,051,680 | 10/1977 | Hall | 60/654 |
| 4,442,675 | 4/1984 | Wilensky | 60/654 |
| 4,573,323 | 3/1986 | Mock | 60/670 X |

*Primary Examiner*—Allen M. Ostrager
*Attorney, Agent, of Firm*—Neal J. Mosely

[57] ABSTRACT

A steam power plant is shown which comprises a pressurized deaerating feed water tank, a high-pressure steam boiler, a high-pressure steam turbine, a low-pressure steam turbine, and a water-cooled, steam condenser, connected in series in a closed circuit. The condenser is maintained under a substantial pressure during operation and connected to supply feed water to the feed water tank. A steam-operated deaerator is connected to the feed water tank to remove air from the water therein. A steam jet is connected between and operable to move steam from the low-pressure turbine to the condenser. A steam jet is connected between and operable to move water from the condenser to the deaerator. A second steam jet is connected to the deaerator to provide steam to scrub the oxygen from the incoming water and permit introduction of a secondary steam source to provide heat as needed. A high-pressure, water injector is connected between and operable to move water from the feed water tank to the boiler. The key to this system is to use injection water of higher pressure than boiler drum pressure. An independent water cycle is required.

31 Claims, 3 Drawing Sheets

STEAM POWER PLANT

BACKGROUND OF THE INVENTION

1. Field of the Invention

This invention relates generally to steam power plants and, more particularly, to a power plant of more efficient design.

2. Brief Description of the Prior Art

Steam power plants have been in use for about two hundred years. Steam turbine power plants for electrical generation have been in use for most of the 20th century.

There are several patents which disclose various types of steam turbine power plants and the auxiliary equipment used therewith.

Smith U.S. Pat. No. 1,573,582 discloses a steam power plant having a prime mover, a condenser, an feed water heater, a circulating pump, an evaporator and a reheater.

May U.S. Pat. No. 3,423,078 discloses a combined jet and air condenser for a turbine power plant.

Hall U.S. Pat. No. 4,051,680 discloses a modified Rankine cycle engine apparatus with a jet pump.

Berry U.S. Pat. No. 4,399,657 discloses a steam generation system with a pressurized boiler and a larger feed water chamber, the boiler being electrically heated.

Engstrom U.S. Pat. No. 556,883 discloses a valve for a steam regenerator which is controlled by pressure of steam from the primary and secondary boilers.

The present invention is distinguished over the prior art in general, and these patents in particular, by a steam power plant which comprises a pressurized deaerating feed water tank, a high-pressure steam boiler, a high-pressure steam turbine, a low-pressure steam turbine, and a water-cooled, steam condenser, connected in series in a closed circuit. The condenser is maintained under a substantial pressure during operation and connected to supply feed water to the feed water tank. A steam-operated deaerator is connected to the feed water tank to remove air from the water therein. A steam jet is connected between and operable to move steam from the low-pressure turbine to the condenser. A steam jet is connected between and operable to move water from the condenser to the deaerator. A second steam jet is connected to the deaerator to provide steam to scrub the oxygen from the incoming water and permit introduction of a secondary steam source to provide heat as needed. A high-pressure, water injector is connected between and operable to move water from the feed water tank to the boiler. The key to this system is to use injection water of higher pressure than boiler drum pressure. This system uses water pressure and velocity to overcome a check valve to the boiler. High-pressure water enters through a nozzle and nozzle opening entraining the feed water and sending both into an expanded space where the water retains enough pressure and velocity to overcome a check valve controlling flow to outlet to a boiler feed pipe. An independent water cycle is required.

SUMMARY OF THE INVENTION

It is therefore an object of the present invention to provide a new and improved steam turbine power plant.

It is another object of this invention is to provide a new and improved steam power plant having a pressurized, deaerating feed water tank.

Another object of this invention is to provide a new and improved steam power plant having a pressurized, deaerating feed water tank and a boiler for steam turbines in which water is moved into the steam boiler by a high-pressure water injector.

Another object of this invention is to provide an improved steam power plant having a steam jet pump used for scrubbing and heating.

Another object of this invention is to provide a new and improved steam power plant having a pressurized, deaerating feed water tank heater by a DC (direct contact) heater, and a boiler for steam turbines in which water is moved into the steam boiler by a high-pressure water injector.

Another object of this invention is to provide a new and improved steam power plant having a pressurized, deaerating feed water tank and a boiler for steam turbines, and a pressurized condenser for condensing steam from the turbines in which steam is moved from the turbines into the condenser by a system of steam injectors.

Still another object of this invention is to provide a new and improved steam power plant having a pressurized, deaerating feed water tank and a boiler for steam turbines, and a pressurized condenser for condensing steam from the turbines in which the condenser is water cooled and air blown out through a gland seal condenser.

Still another object of this invention is to provide a new and improved steam power plant having a pressurized, deaerating feed water tank and a boiler for steam turbines, and a pressurized condenser for condensing steam from the turbines in which water from the condenser is recirculated to the feed water tank by a steam injector.

A further object of this invention is to provide an improved steam power plant having a pressurized, deaerating feed water tank and a boiler for steam turbines in which water is moved into the steam boiler by a high-pressure water injector, and a pressurized condenser for condensing steam from the turbines in which steam is moved from the turbines into the condenser by a system of steam injectors.

A further object of this invention is to provide an improved steam power plant in which water is moved into the steam boiler by a high-pressure water injector in which the injection water of higher pressure than boiler drum pressure and is injected at a velocity sufficient to overcome a check valve to the boiler.

A further object of this invention is to provide an improved steam power plant in which water is moved into the steam boiler by a high-pressure water injector in which the injection water from an independent water cycle of higher pressure than boiler drum pressure and is injected through a nozzle and nozzle opening entraining the feed water and sending both into an expanded space where the water retains enough pressure and velocity to overcome a check valve controlling flow to outlet to a boiler feed pipe.

Other objects of the invention will become apparent from time to time throughout the specification and claims as hereinafter related.

The above noted objects and other objects of the invention are accomplished by a novel steam power plant which comprises a pressurized deaerating feed water tank, a high-pressure steam boiler, a high-pressure steam turbine, a low-pressure steam turbine, and a water-cooled, steam condenser, connected in series in a closed circuit. The condenser is maintained under a substantial pressure during operation and connected to supply feed water to the feed water tank. A steam-operated deaerator is connected to the feed water tank to remove air from the water therein. A steam jet is connected between and operable to move steam from the low-pressure turbine to the condenser. A steam jet is connected between and operable to move water from the condenser to the deaerator. A second steam jet is connected to the deaerator to provide steam to scrub the oxygen from the incoming water and permit introduction of a secondary steam source to provide heat as needed. A high-pressure, water injector is connected between and operable to move water from the feed water tank to the boiler. The key to this system is to use injection water of higher pressure than boiler drum pressure. This system uses water pressure and velocity to overcome a check valve to the boiler. High-pressure water enters through a nozzle and nozzle opening entraining the feed water and sending both into an expanded space where the water retains enough pressure and velocity to overcome a check valve controlling flow to outlet to a boiler feed pipe. An independent water cycle is required.

DESCRIPTION OF A PRIOR-ART SYSTEM

Figure 1:
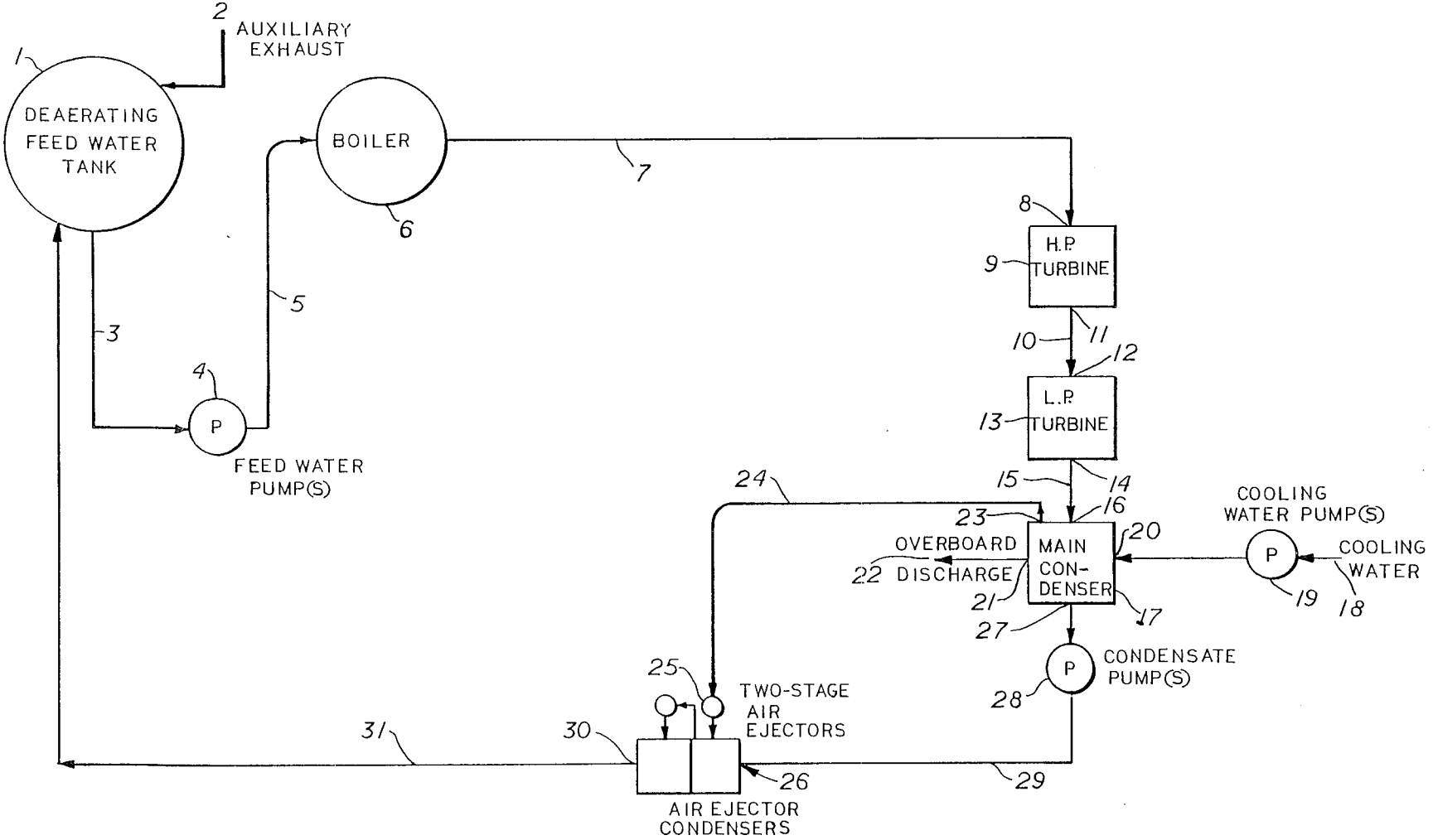
FIG. 1 (PRIOR ART)
FIG. 1 is a schematic view of a two-stage, steam turbine power plant illustrating a conventional, prior-art system as used on marine vessels.

Referring to the drawings by numerals of reference, and more particularly to FIG. 1, there is shown a prior-art steam power plant of the type used in marine applications. The system comprises a deaerating feed water tank 1 having an auxiliary exhaust line 2 to provide steam to the tank for scrubbing and for heating water by direct contact. Feed water tank 1 is connected by pipe(s) 3 to feed water pump(s) 4 which are connected by pipe(s) 5 to high-pressure steam boiler 6.

Boiler 6 is connected by pipe 7 to inlet 8 of highpressure steam turbine 9. Steam pipe 10 connects outlet 11 of high-pressure turbine 9 to inlet 12 of low-pressure steam turbine 13. Outlet 14 of low-pressure steam turbine 13 is connected by pipe 15 to inlet 16 of the main steam condenser 17. Condenser 17 is a water-cooled condenser supplied with cooling water from a source 18 (e.g., the ocean) by cooling water pump(s) 19 to cooling water inlet 20 to condenser 17. Spent cooling water from condenser 17 is discharged through cooling water outlet 21 to overboard discharge 22. Outlet 23 from condenser 17 is connected by pipe 24 to a two-stage air ejector 25 having air ejector condenser(s) 26.

Outlet 27 from condenser 17 is connected to the inlet side of condensate pump(s) 28, the outlet side of which is connected by pipe(s) to the condensate inlet to air ejector condenser(s) 26. Outlet side 30 of air ejector condenser(s) 26 is connected by pipe(s) 31 to return condensate to feed water tank 1.

In operation, feed water tank 1 is maintained at a pressure of about 15 p.s.i. The temperature of the feed water is limited due to the low-pressure. The feed water is moved by feed water pump(s) 4 to boiler 6. High-pressure steam from boiler 6 is fed to high-pressure turbine 9 for power generation. The steam exhausted from high-pressure turbine 9 is fed to low-pressure turbine 13 for power generation. Vacuum is created in the outlet side of low-pressure turbine 13 by rapidly condensing its exhaust steam in condenser 17 solely by cooling with cooling water. The exhaust steam is condensed under vacuum then reheated on its way back to the boiler by preheaters (not shown). Condensate pumps 28 are used to remove the condensate. Condensate is therefore fed into the tank by pumps which use an external energy source. Steam used for scrubbing is taken from an external source and is limited due to the added heat brought in by the scrubbing steam. These factors contribute to an inefficiency in the overall system.

DESCRIPTION OF A PREFERRED EMBODIMENT

In considering the design and operation of this system, there are three separate areas which are important; the pressurized condensing system 58, the pressurized deaerating feed tank 41, and the high-pressure feed water injection system 59, described more fully below. Each of these three systems are beneficial in their own right and together they make for a superior steam cycle.

In considering this system, four basic principles should be kept in mind:

(1) For every given pressure there is a known temperature at which water will evaporate or steam condenses.

(2) The difference between sensible heat which is measurable heat (it takes one B.T.U. to raise one pound of water one degree) and latent heat needed to change the physical state of a substance at a given temperature (boiling point). It should be noted that it only takes 180 B.T.U. to raise the temperature (sensible) of one pound of water from the freezing point 32° to the boiling point 212° at atmospheric pressure while it takes a full 970 B.T.U. (latent) to change that one pound of water to steam (or steam to water) at 212° atmospheric.

(3) The third principle to be considered is the relation between the first two, i.e., the lower the pressure, the lower the boiling point is (sensible heat) and the more latent heat which must be removed to condense the steam; the higher the pressure, the higher the boiling point is (sensible) and the less latent heat which must be removed to condense the steam.

(4) The fourth principle is the relation between velocity and pressure as it pertains to jet pumps. The pressure of a substance may be overcome by increasing its velocity through a nozzle.

In the condenser system 58, a vacuum is produced in the turbine casing by a system of injector nozzles; turbine exhaust is transferred into the condenser; and a seal is provided between the pressurized condenser and the turbine casing under vacuum.

Steam should be supplied to the injector nozzles in the following manner. Steam from inside the condenser should be used as supply steam. Once pressurized steam pressure in the condenser will remain available since the potential energy in the condenser will be transmitted to the injectors in the form of kinetic energy and back to stored energy in the condenser.

The turbine exhaust, and other steam sources, entering the condenser will provide enough heat to maintain a constant high pressure in the condenser. Exhaust steam being at a lower pressure than the condenser much of the exhaust steam will condense. Condenser cooling water from the circulating pump removes the excess heat remaining.

This system operates with a pressurized deaerating feed tank. Ordinarily this would eliminate any benefits in pumping condensate but it is overcome by the use of steam injector pumps.

The purpose of this system is of course to condense steam under pressure. The higher the pressure the more sensible and latent heat is retained in the condensate. For better regulation, a bypass is provided for the condenser cooling water. A gland seal condenser, and vent condenser if needed, is placed in cooling side stream drawing water from the cooling water line from the condenser. If pressure is high enough in the condenser, it can be used in place of L.P. bleed and I.P. bleed steam and/or as make-up for the auxiliary exhaust.

In prior-art systems, vacuum is created in the turbine by rapidly condensing its exhaust steam; condensing takes place in the condenser solely by cooling with cooling water; exhaust steam is condensed under vacuum then reheated on its way back to the boiler by preheaters; and condensate pumps are used to remove the condensate.

In this system, vacuum is created in the turbine be use of a jet pump; condensing takes place in the condenser partially because of the higher pressure in the condenser; and because of pressure in the condenser a positive head pressure will exist.

As a result of the higher pressure in the condenser, the exhaust steam will condense at a higher temperature and in doing so the condensate will retain a greater amount of heat. L.P. turbine bleed steam, and possibly the I.P. bleed steam, can be replaced by pressurized steam in the condenser. Condensate pumps are eliminated. Air ejectors are eliminated. The pressure or temperature of the deaerating feed heater is not critical as long as it operates near saturation temperature and has a steam supply able to provide a good scrubbing effect. With pressure in the condenser providing lift the condensate pumps are eliminated. Since the deaerator is under pressure an orifice or other restricting device should be placed in the deaerator exhaust.

In prior-art systems, condensate is fed into the feed water tank by pumps using an external energy source; pressure in the tank is only 15 p.s.i.: temperature of the feed water is limited due to the low-pressure: steam used for scrubbing is taken from an external source; and scrubbing is limited due to the added heat brought in by the scrubbing steam.

In this system, condensate is fed into the tank by a jet pump using steam pressure generated in the tank, resulting in no energy loss; pressure in the tank is higher; temperature of the feed water stored in the tank can be higher due to the higher pressure; due to the higher pressure in the tank there is a greater head pressure exerted on the feed water; a jet pump using steam pressure from within the tank to power it is used for scrubbing and to bring in an external supply of steam for heating; using steam from within the tank for scrubbing adds no additional heat to the tank therefore all the steam desired can be used for scrubbing; and by regulating the amount of externally supplied steam entering the tank, the tank pressure and feed water temperature are controlled.

A high-pressure injection system is used in the boiler. The key to this system is to use injection water of higher pressure than boiler drum pressure. Instead of steam velocity (as used in current injectors) this system uses water pressure and velocity to overcome a check valve to the boiler. This system will be described more fully below. The difference between this system and prior-art systems is that prior-art, high-pressure systems use externally powered feed pumps. This system uses a jet pump powered by pressurized boiler water. By using a jet pump this water and its heat is returned to the boiler resulting in no energy loss. In some low-pressure boilers, steam injectors are used but they have proven to unreliable for greater use. These injectors are powered by steam from the boiler steam drum. They use boiler operating pressure based on the principle that velocity overcomes pressure. The difference between these injectors and the present invention is that instead of steam at boiler operating pressure the present invention uses water at higher than boiler operating pressure as discussed before.

In FIGS. 2–7, there is shown a preferred embodiment of this invention. It is shown as a plant of the type used in marine applications although it may me used in other applications. The system comprises a pressurized deaerating feed water tank 41 supplied with feed water from the steam injectors, and water recirculated from the condenser. Feed water tank 41 is connected by pipe 42 to high-pressure steam boiler 43.

A steam injector 45 is connected to feed water tank 41 and is supplied with steam for operation through line 47. from secondary steam source 46. Tank 41 is supplied with heat by a direct contact heating by steam from secondary steam source 46 drawn in through steam injector 45. Air from the internal deaerator arrangement is bled off through line 141 to vent 142. An orifice or choke valve 44 is positioned in line 141 to maintain a selected pressure in the deaerator.

Boiler 43 is connected by pipe 48 to inlet 4 of high-pressure steam turbine 50. Steam pipe 51 connects outlet 52 of high-pressure turbine 50 to inlet 53 of low-pressure steam turbine 54. Outlet 55 of low-pressure steam turbine 54 is connected to inlet 56 of steam injector jet assembly 57 which moves the steam from the outlet end of turbine 54 into the main steam condenser 58.

Figure 2:
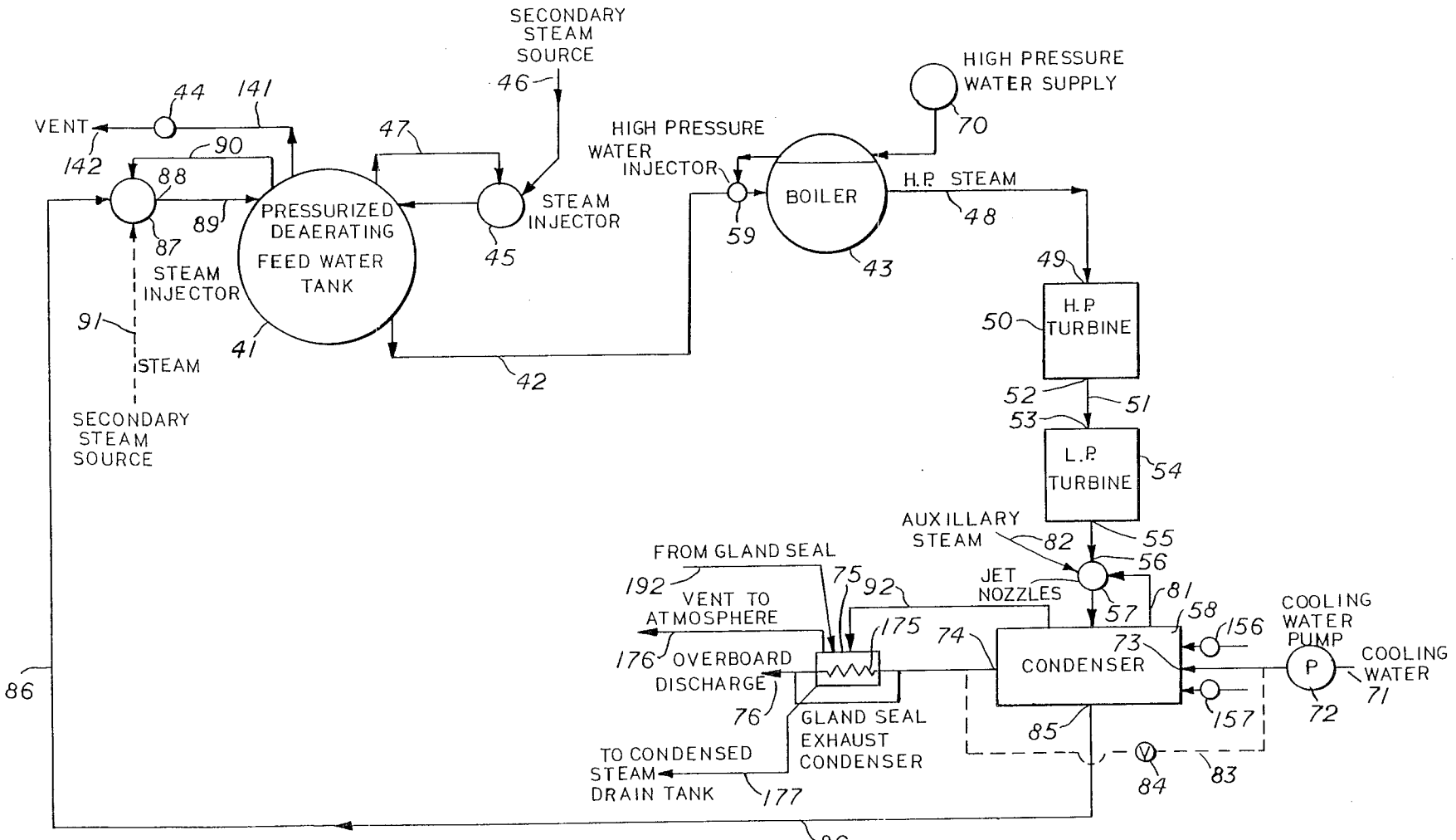
FIG. 2 is a schematic view of a two-stage, steam turbine power plant illustrating a preferred embodiment of this invention.
Figure 5:
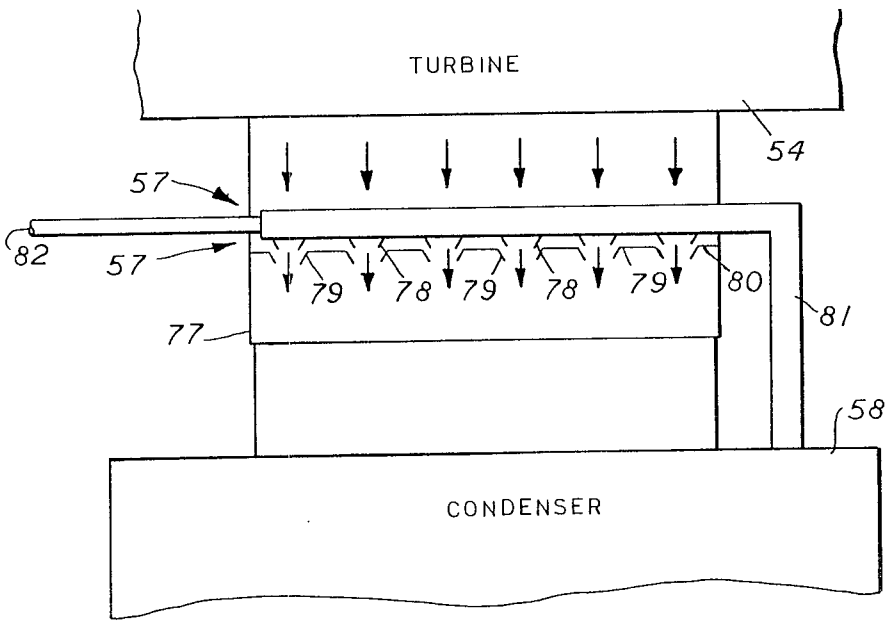
FIG. 5 is a schematic view of a system of steam injectors used as a pump for moving steam from a low-pressure turbine into a water cooled condenser in this invention.
Figure 6:
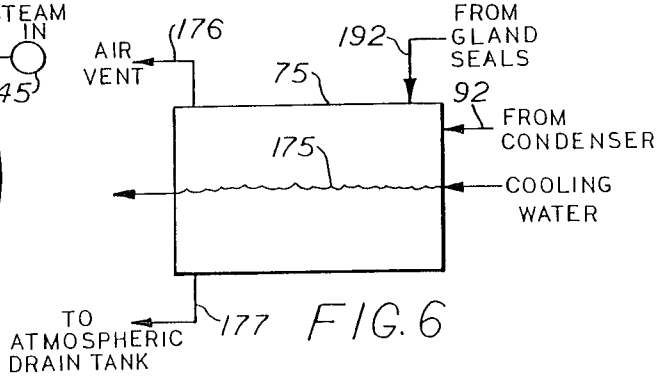
FIG. 6 is a schematic view of a gland seal condenser used in this invention for deaerating steam from the spent steam condenser adjacent the low-pressure turbine.
Figure 7:
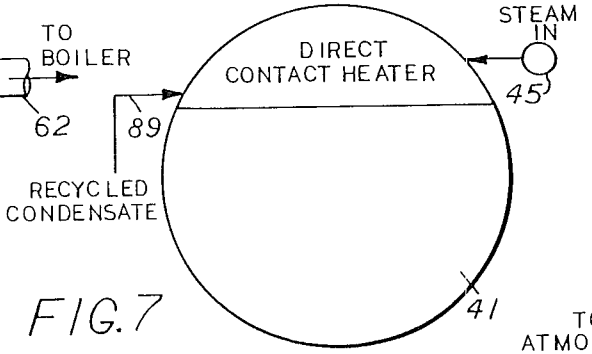
FIG. 7 is a schematic view showing some additional details for the deaerating feed water tank.
Figure 3:
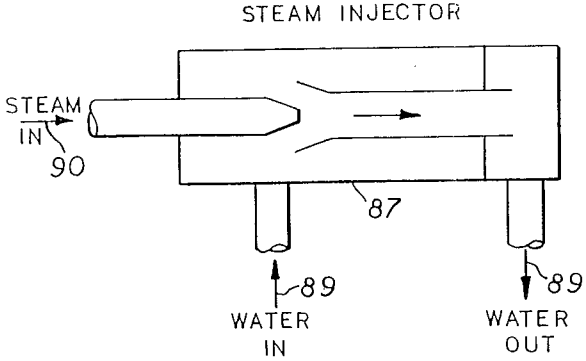
FIG. 3 is a schematic view of a steam injector pump used in this invention.
Figure 4:
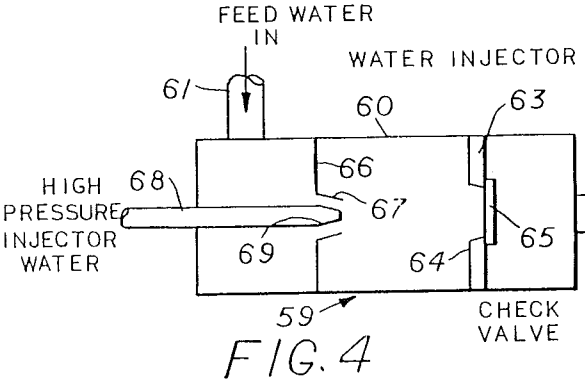
FIG. 4 is a schematic view of a high-pressure water injector used for moving feed water into the steam boiler in this invention.

Water is made to flow into high-pressure boiler 43 from feed water tank 41 by means of a high-pressure water injector 59 (FIGS. 2 and 4). Water injector 59 has a housing 60 with feed water inlet 61 and outlet 62 to boiler 43 Housing 60 has an internal wall 63 with a valve opening 64 and a check valve 65 opening on flow of water toward the outlet and closing on back flow. A second internal wall 66 has a nozzle opening 67. An injector pipe 68 extends into the feed water inlet end of housing 60 and has a nozzle extending into nozzle opening 67 in wall 66.

The key to this system is to use injection water of higher pressure than boiler drum pressure. Instead of steam velocity (as used in current steam injectors) this system uses water pressure and velocity to overcome the check valve to the boiler.

High-pressure water enters through nozzle 69 and nozzle opening 67 entraining the feed water and sending both into the expanded space between walls 63 and 66. In this expanded space, water pressure is reduced but the water retains enough pressure and velocity to overcome the check valve 65 controlling flow to outlet 62 to the boiler feed pipe.

To get a higher pressure than boiler operating pressure, an independent water cycle is required. This consists of two separate water drums (or a split drum) with tube banks and headers connected to the water drums, a valve and regulator arrangement for each drum to control flow and temperature, collectively shown schematically as high-pressure water supply 70 in FIG. 2. For additional water to keep up with demand, storage tanks for each cycle may be required. These tanks should be located outside the boiler. The tube nest should be enough to provide adequate heating.

This is accomplished with the valve and regulator arrangement. This arrangement consists of five valves (not shown) for each cycle. All valves are outside the boiler in a convenient arrangement. Each set of valves serves five basic functions. The first valve provides water to the injector 59. The second valve equalizes the pressure of one cycle with that of boiler operating pressure when this cycles water level has fallen too low for use in the injector.

The third and fourth valves are the filling valve and the free flow valve. Once pressure has been equalized, this cycle can fill with boiler feed water at operating pressure. The fill valve and the free flow valve remain open until the other cycle has reached a specific point. This will allow a free flow through the system until it is ready for use. When ready for use, the free flow and filling valves close. When the pressure has reached the desired level it will take over and the other cycle begins to equalize.

The functions of the four valves mentioned being repeated continuously serves as the basis for this high-pressure system. The fifth valve controls temperature and pressure. It is a bypass for the cycle in use. Water from this cycle is diverted through the boiler steam drum below the water level. By cooling the cycle in this manner, temperature and pressure are controlled. The five valves mentioned are operating valves. A safety valve may be included if required.

For safety and for filling a cold boiler, a cross connect is provided. Thus, the high-pressure water requirements of the injection system for one boiler can meet the minimum operating needs of the other boiler during start up or casualty if need be.

A principal difference between this system and prior art systems is that prior-art high-pressure systems use externally powered feed pumps. This system uses a jet pump powered by pressurized boiler water. By using a jet pump this water and its heat is returned to the boiler resulting in no energy loss.

Condenser 58 is a water-cooled condenser supplied with cooling water from a source 71 (e.g., the ocean) by cooling water pump(s) 72 to cooling water inlet 73 to the condenser. Spent cooling water from condenser 58 is discharged through cooling water outlet 74 to overboard, or other, discharge 76. Part of the cooling water is passed through a side strean in line 175 to cool a gland seal condenser 75. Gland seal condenser has an inlet line 192 from the gland seals, an inlet line 92 from the main condenser 58, an air vent line 176 and an athmospheric drain line 177. A crossover line 83 bypasses condenser 58 and is controlled by valve 84, which may be automatic, to regulate the condenser. Steam injector 156 brings make-up feed-atmospheric and distiller drains to condenser 58. Steam injector 58 beings in the auxiliary exhaust dump to the condenser 58.

Steam injector jet assembly 57 (FIGS. 2 and 5) acts as a pump to draw exhaust steam from low-pressure turbine 54 into condenser 58. Steam injector jet assembly 57 has a housing 77 which is a large exhaust pipe from low-pressure turbine 54. Circling the inside of housing 77 are a plurality of nozzles 78 extending through conical nozzle openings 79 in a plate 80 in the housing taking suction from one side and discharging to the other.

Steam from inside the condenser is used as supply steam through pipe 81. Pressurized steam in the condenser will remain available since the potential energy in the condenser will be transmitted to the injectors in the form of kinetic energy and back to stored energy in the condenser. The turbine exhaust (auxiliary steam sources 82 may also be used) entering the condenser provide enough heat to maintain a constant high-pressure in the condenser.

Exhaust steam being at a lower pressure than the condenser much of the exhaust steam will condense. Condenser cooling water from the circulating pump 72 removes the excess heat remaining. There is a significant reduction in the size and demand placed on the circulating pump and related piping.

To prevent being forced to use live steam to maintain pressure in condenser 58 when under stop conditions for long periods of time a crossover line may be installed from the generator condensers. This way the generator condenser can be shut down and its exhaust used to provide the necessary steam and heat needed to maintain a constant pressure in the main condenser. When adequate steam flow has returned pressure from the main condenser can be used to restore the smaller generator condenser to operation. A back up supply 82 of steam is provided for all condensers to build pressure and start the injectors.

Outlet 85 from condenser 58 is connected by pipe 86 to the inlet side of steam injector 87. Outlet side 88 of steam injector 87 is connected by pipe 89 to return condensate to feed water tank 41. Steam injector 87 is supplied with steam by pipe 90 from feed water tank 41 and by secondary steam source 91.

OPERATION

In operation, feed water tank 41 is operated under a substantially higher pressure than in prior-art systems. Tank 41 is supplied with heat by a direct contact heating by steam from secondary steam source 46 drawn in through steam injector 45. Air from the internal deaerator arrangement is bled off through line 141 to vent 142. An orifice or choke valve 44 is positioned in line 141 to maintain a selected pressure in the deaerator.

Deaerated, pressurized feed water from tank 41 flows through line 42 into boiler 43 under the influence of highpressure water injector 59. High-pressure steam flows through line 48 into high-pressure turbine 50. The spent steam from turbine 50, still retaining substantial available energy, flows through low-pressure turbine 54. The use of high-pressure and low-pressure turbines in series results in a much higher use of the available energy in the steam.

Jet nozzle assembly 57, supplied with steam from condenser 58 and from auxiliary steam source 82, draws down the pressure on the outlet side of turbine 54 and moves the spent steam into condenser 58. The steam is condensed in condenser 58 by cooling water from source 71 circulated by pump 72 through the condenser 58 and gland seal condenser 75.

Air separated from the steam in condenser 58, along with a small amount of steam and/or condensate is blown by the relatively high-pressure in the condenser through line 92 into gland seal condenser 75 where the remaining steam is condensed and air is discharged. The condensate from condenser 58 is recirculated to feed water tank 41 by steam injector(s) 87.

While this invention has been shown fully and completely with special emphasis on certain preferred embodiments, it should be understood that within the scope of the appended claims the invention may be practiced otherwise than as specifically described herein.

What is claimed:

1. A steam power plant comprising, in combination deaerating feed water tank, a high-pressure steam boiler, a high-pressure steam turbine, a low-pressure steam turbine, and a water-cooled, steam condenser, connected in series in a closed circuit, said condenser being maintained under a substantial pressure during operation, and being connected to supply feed water to said feed water tank, means connected to said to separate and remove air from the water in said feed water tank, steam jet means connected between and operable to move steam from said low-pressure turbine to said condenser, high-pressure, water injection means connected between and operable to move water from said feed water tank to said boiler, and steam jet pump means connected between and operable to move water condensate from said condenser to said feed water tank.

2. A steam power plant according to claim 1 in which said feed water tank includes a steam injector connected to an external source of steam to supply steam into said tank for scrubbing and supplying heat to the feed water, and operating steam being supplied from the tank itself.

3. A steam power plant according to claim 1 including a steam injector connected between said condenser and said feed water tank for moving water therebetween, a steam injector connected to said feed water tank, and an external source of steam for said injector.

4. A steam power plant according to claim 1 in which said feed tank has an air vent for discharging air to atmosphere.

5. A steam power plant according to claim 1 in which said feed tank has an air vent for discharging air to atmosphere, and orifice means in said air vent to maintain a predetermined pressure in said tank.

6. A steam power plant according to claim 1 in which said condenser includes water-cooled heat-exchange means having discharge conduit means, inlet conduit means adapted for connection to an external body of water, and pump means for circulating cooling water therethrough.

7. A steam power plant according to claim 1 in which said condenser includes water-cooled heat-exchange means having discharge conduit means, inlet conduit means adapted for connection to an external body of water, and pump means for circulating cooling water therethrough, and exhaust condenser means connected for cooling by at least part of the water flowing through said discharge conduit means and connected to receive steam from said condenser and to discharge air to atmosphere.

8. A steam power plant according to claim 1 in which said steam jet means connected between and operable to move steam from said low-pressure turbine to said condenser comprises a housing connected at one end to said low-pressure turbine and at the other end to said condenser, a plate extending across said housing to divide it into an inlet an an outlet chamber, said plate having a plurality of nozzle openings constructed therein, and a plurality of nozzles extending through said nozzle openings in said plate inducing suction in the exhaust from said turbine.

9. A steam power plant according to claim 8 in which said housing is tubular and said nozzle openings extend through said plate around the periphery thereof.

10. A steam power plant according to claim 8 in which said housing is tubular and said nozzle openings extend through said plate around the periphery thereof, and including means connecting said housing to said condenser to conduct steam from said condenser to said nozzles.

11. A steam power plant according to claim 8 in which said housing is tubular and said nozzle openings extend through said plate around the periphery thereof, and including means connecting said housing to said condenser and to an external steam source to conduct steam from said condenser and from said external steam source to the inlet to said nozzles.

12. A steam power plant according to claim 1 in which said condenser includes a pump having an inlet connected to a source of cooling water and an outlet connected to one side of the condenser, conduit means bypassing cooling water around said condenser, and valve means controlling flow through said conduit means.

13. A steam power plant according to claim 1 in which said condenser includes a pump having an inlet connected to a source of cooling water and an outlet connected to one side of the condenser, a gland seal exhaust condenser, and means connecting said condenser to said gland seal condenser to exhaust air therethrough.

14. A steam power plant according to claim 1 in which said high-pressure, water injection means comprises a housing having an inlet connected to said feed water tank and an outlet connected to said boiler, an injector nozzle positioned in said housing adjacent to said housing inlet, check valve means positioned between said injector said housing outlet, and a source of high-pressure water connected to said injector nozzle to supply high-pressure water thereto, whereby the flow of a small amount of high-pressure water through said housing induces flow of water from said feed water tank to said boiler.

15. A steam power plant according to claim 1 in which said source of high pressure water includes two separate water drums with tube banks and headers connected thereto, a valve and regulator means for each drum to control flow and temperature, storage tanks for each cycle of operation located outside the boiler.

16. A steam power plant according to claim 15 in which said valve and regulator means comprises five valves for each cycle, located outside the boiler, a first valve controls water flow to said injector, a second valve equalizes the pressure of one cycle with that of boiler operating pressure on occurrence of a predetermined low water level, a third valve controls filling, a fourth valve permits free flow, and a fifth valve controls temperature and pressure.

17. A steam power plant according to claim 1 in which said steam-operated deaerating means connected to said feed water tank includes a steam injector connected between said condenser and said feed water tank for moving water therebetween, a steam injector connected to said feed water tank, an external source of steam for said steam injector, and said condenser includes water-cooled heat-exchange means having discharge conduit means, inlet conduit means adapted for connection to an external body of water, and pump means for circulating cooling water therethrough.

18. A steam power plant according to claim 1 in which said steam-operated deaerating means connected to said feed water tank includes a steam injector connected between said condenser and said feed water tank for moving water therebetween, a steam injector connected to said feed water tank, an external source of steam for said steam injector, said condenser includes water-cooled heat-exchange means having discharge conduit means, inlet conduit means adapted for connection to an external body of water, and pump means for circulating cooling water therethrough, and exhaust condenser means connected for cooling by part of said cooling water and connected to receive steam from said condenser and to discharge air to atmosphere.

19. A steam power plant according to claim 1 in which said steam-operated deaerating means connected to said feed water tank includes a steam injector connected between said condenser and said feed water tank for moving water therebetween, a steam injector connected to said feed water tank, an external source of steam for said steam injector, and said condenser includes water-cooled heat-exchange means having discharge conduit means, inlet conduit means adapted for connection to an external body of water, and pump means for circulating cooling water therethrough, exhaust condenser means connected for cooling by part of said cooling water and connected to receive steam from said condenser and to discharge air to atmosphere, said steam jet means connected between and operable to move steam from said low-pressure turbine to said condenser comprises a housing connected at one end to said low-pressure turbine and at the other end to said condenser, a plate extending across said housing to divide it into an inlet an an outlet chamber, said plate having a plurality of nozzle openings therethrough, and a plurality of nozzles extending through the nozzle openings in said plate inducing suction in the exhaust from said turbine.

20. A steam power plant according to claim 1 in which said steam-operated deaerating means connected to said feed water tank includes a steam injector connected between said condenser and said feed water tank for moving water therebetween, a steam injector connected to said feed water tank, an external source of steam for said steam injector, said condenser includes water-cooled heat-exchange means having discharge conduit means, inlet conduit means adapted for connection to an external body of water, and pump means for circulating cooling water therethrough, exhaust condenser means connected for cooling by part of said cooling water and connected to receive steam from said condenser and to discharge air to atmosphere, said steam jet means connected between and operable to move steam from said low-pressure turbine to said condenser comprises a housing connected at one end to said low-pressure turbine and at the other end to said condenser, a plate extending across said housing to divide it into an inlet an an outlet chamber, said plate having a plurality of nozzle openings therethrough, a plurality of nozzles extending through the nozzle openings in said plate inducing suction in the exhaust of said turbine, said condenser includes a pump having an inlet connected to a source of cooling water and an outlet connected to one side of the condenser, conduit means bypassing cooling water around said condenser, and valve means controlling flow through said conduit means.

21. A steam power plant according to claim 20 in which said condenser includes a pump having an inlet connected to a source of cooling water and an outlet connected to one side of the condenser, a gland seal exhaust condenser, and means connecting said condenser to said gland seal condenser to exhaust air therethrough.

22. A steam power plant according to claim 20 in which said high-pressure, water injection means comprises a housing having an inlet connected to said feed water tank and an outlet connected to said boiler, an injector nozzle positioned in said housing adjacent to said inlet, check valve means positioned between said injector nozzle and said housing outlet, and a source of high-pressure water connected to said injector nozzle to supply high-pressure water thereto, whereby the flow of a small amount of high-pressure water through said housing induces flow of water from said feed water tank to said boiler.

23. A steam power plant according to claim 22 in which said source of high pressure water includes two separate water drums with tube banks and headers connected thereto, a valve and regulator means for each drum to control flow and temperature, storage tanks for each cycle of operation located outside the boiler.

24. A steam power plant according to claim 23 in which said valve and regulator means comprises five valves for each cycle, located outside the boiler, a first valve controls water flow to said injector, a second valve equalizes the pressure of one cycle with that of boiler operating pressure on occurrence of a predetermined low water level, a third valve controls filling, a fourth valve permits free flow, and a fifth valve controls temperature and pressure.

25. In a steam power plant, a feed water apparatus comprising a pressurized deaerating feed water tank, said feed water tank including a steam injector adapted to be connected to an external source of steam to supply steam into said tank for scrubbing recycled condensate and supplying heat to the feed water, and operating steam being supplied from the tank itself.

26. In a steam power plant, a condenser apparatus comprising a water-cooled, steam condenser, said condenser being maintained under a substantial pressure during operation, and adapted to be connected on one side to supply feed water to a feed water tank and on another side to the exhaust from a steam engine, means connected to separate and remove air from the water in said tank, and steam jet means connected to said other side of said condenser and adapted to be connected to the exhaust from a steam engine operable to move spent steam from said steam engine to said condenser.

27. In a steam power plant according to claim 26, said condenser including water-cooled heat-exchange means having discharge conduit means, inlet conduit means adapted for connection to an external body of water, and pump means for circulating cooling water therethrough, exhaust condenser means connected for cooling by part of said cooling water and connected to receive steam from said condenser and to discharge air to atmosphere, said steam jet means comprising a housing adapted to be connected at one end to said steam engine and at the other end to said condenser, a plate extending across said housing to divide it into an inlet an an outlet chamber, said plate having a plurality of nozzle openings therethrough, a plurality of nozzles extending through the nozzle openings in said plate inducing suction in the outlet from said turbine, said condenser includes a pump having an inlet adapted to be connected to a source of cooling water and an outlet connected to one side of the condenser, conduit means bypassing cooling water around said condenser, and valve means controlling flow through said conduit means.

28. In a steam power plant, a boiler apparatus comprising a high-pressure boiler, and high-pressure, water injection means connected to inject water at a pressure higher than the boiler pressure to induce movement of water from a feed water tank into said boiler.

29. In a steam power plant according to claim 28 said boiler apparatus water injection means comprising a housing having an inlet adapted to be connected to a feed water tank and an outlet connected to said boiler, an injector nozzle positioned in said housing adjacent to said inlet, check valve means positioned between said injector nozzle and said housing outlet, and a source of high-pressure water connected to said injector nozzle to supply high-pressure water thereto, whereby the flow of a small amount of high-pressure water through said housing induces flow of water from said feed water tank to said boiler.

30. In a steam power plant according to claim 29 said bolier apparatus source of high pressure water including two separate water drums with tube banks and headers connected thereto, a valve and regulator means for each drum to control flow and temperature, storage tanks for each cycle of operation located outside the boiler.

31. In a steam power plant according to claim 30 said valve and regulator means comprising five valves for each cycle, located outside the boiler, a first valve controls water flow to said injector, a second valve equalizes the pressure of one cycle with that of boiler operating pressure on occurrence of a predetermined low water level, a third valve controls filling, a fourth valve permits free flow, and a fifth valve controls temperature and pressure.

* * * * *